US005427085A

United States Patent [19]

Martin

[11] Patent Number: 5,427,085

[45] Date of Patent: Jun. 27, 1995

[54] ARCHERY BOW AND RADIATION SHIELDING APPARATUS FOR AN ARCHERY BOW

[75] Inventor: Terry G. Martin, Walla Walla, Wash.

[73] Assignee: Martin Archery, Inc., Walla Walla, Wash.

[21] Appl. No.: 998,862

[22] Filed: Dec. 30, 1992

[51] Int. Cl.[5] ..... F41B 5/14

[52] U.S. Cl. ..... 124/23.1; 124/1

[58] Field of Search ..... 124/23.1, 1, 24.1, 25, 124/25.5, 25.6, 26; 250/515.1

[56] References Cited

U.S. PATENT DOCUMENTS

| | | | |
|---|---|---|---|
| 2,665,678 | 1/1954 | Bear | 124/23.1 |
| 3,061,491 | 10/1962 | Sherrard | 250/515.1 |
| 3,850,156 | 11/1974 | Eicholtz | 124/23.1 |
| 3,895,143 | 7/1975 | Tarlow | 250/515.1 |
| 4,671,249 | 6/1987 | Troncoso | 124/23.1 |
| 4,905,392 | 3/1990 | Klein . | |
| 5,107,565 | 4/1992 | Chun . | |

FOREIGN PATENT DOCUMENTS 3737208 5/1988 Germany .

*Primary Examiner*—Randolph A. Reese
*Assistant Examiner*—Anthony Knight
*Attorney, Agent, or Firm*—Wells, St. John, Roberts, Gregory & Matkin

[57] ABSTRACT

A radiation shielding apparatus for an archery bow includes reflective sheets of material adhereable to a bow limb face. The sheets are comprised of different sizes, including multiple height dimensions and different width dimensions. Each sheet has an outer glossy reflective surface and an inner surface. An adhesive is applied to the inner surface to enable the sheets to be removably adhered to the bow limb face. The glossy surface deflects light radiation away from the bow limb to minimize heating of the bow limb. An archery bow in accordance with the invention includes such sheets.

24 Claims, 6 Drawing Sheets

ARCHERY BOW AND RADIATION SHIELDING APPARATUS FOR AN ARCHERY BOW

TECHNICAL FIELD

This invention relates to temperature change in archery bow limbs.

BACKGROUND OF THE INVENTION

There are two primary types of archery: target archery and field archery. Many archers participate in both target and field archery.

Accuracy in field or target archery depends primarily on consistency. The archer must employ a consistent shooting form; that is, the archer must draw the bow, aim, release, and follow through the same each time the bow is shot. Likewise, the equipment used by the archer must perform consistently each time the bow is shot in order for the arrows to fly in a similar manner.

A traditional problem with respect to bow performance relates to the temperature of the bow limbs. The limbs of a bow store energy when the bow is drawn. This stored energy is transferred to the arrow upon release of the bow string. For the arrows to fly at a common speed, the limbs must store a constant amount of energy for a given bow draw length. When the temperature of the bow limbs varies, the amount of energy stored by the limbs will also vary.

Generally, when the temperature of a bow limb increases, the efficiency and performance of the bow limb changes. An arrow shot from a bow with warm limbs will hit lower on a target at a given distance than an arrow shot from a bow with the same but relatively cooler limbs. This problem generally surfaces in outdoor shooting situations where sunlight may cause the bow limbs to absorb heat, thus reducing performance. With respect to laminated bow limbs, a certain increase in temperature may even cause such bow limbs to delaminate.

Accordingly, there is a need for an archery bow equipment that will minimize heating of bow limbs to enhance the consistency of a bow's performance. There is also a need for equipment that will allow an archer to use a common bow for both field and target archery.

BRIEF DESCRIPTION OF THE DRAWINGS

One or more preferred forms of the invention are described herein with reference to the accompanying drawings. The drawings are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, a radiation shielding apparatus comprising:

a thin sheet of material, the sheet having an outer surface and an inner surface, the inner surface being adapted for adherence to a bow limb face, the outer surface being glossy and reflective of light radiation to deflect light away from a bow limb when the inner surface is adhered to a bow limb to minimize heating of a bow limb.

The invention also comprises an archery bow incorporating such a radiation shielding apparatus. Further, an archery bow in accordance with the invention comprising:

a handle portion having opposing ends;

opposing bow limbs coupled to the opposing ends of the handle portion, the limbs each having opposing outer and inner faces and having side edges which define a series of face widths therebetween, each outer limb face having a length;

a bow string extending between the opposing bow limbs; and sheet means removably adhered to the outer face of one of said bow limbs, said sheet means having an outer surface and an inner surface, the sheet means outer surface being glossy and reflective of light radiation to deflect light away from said bow limb to minimize heating thereof.

Figure 1:
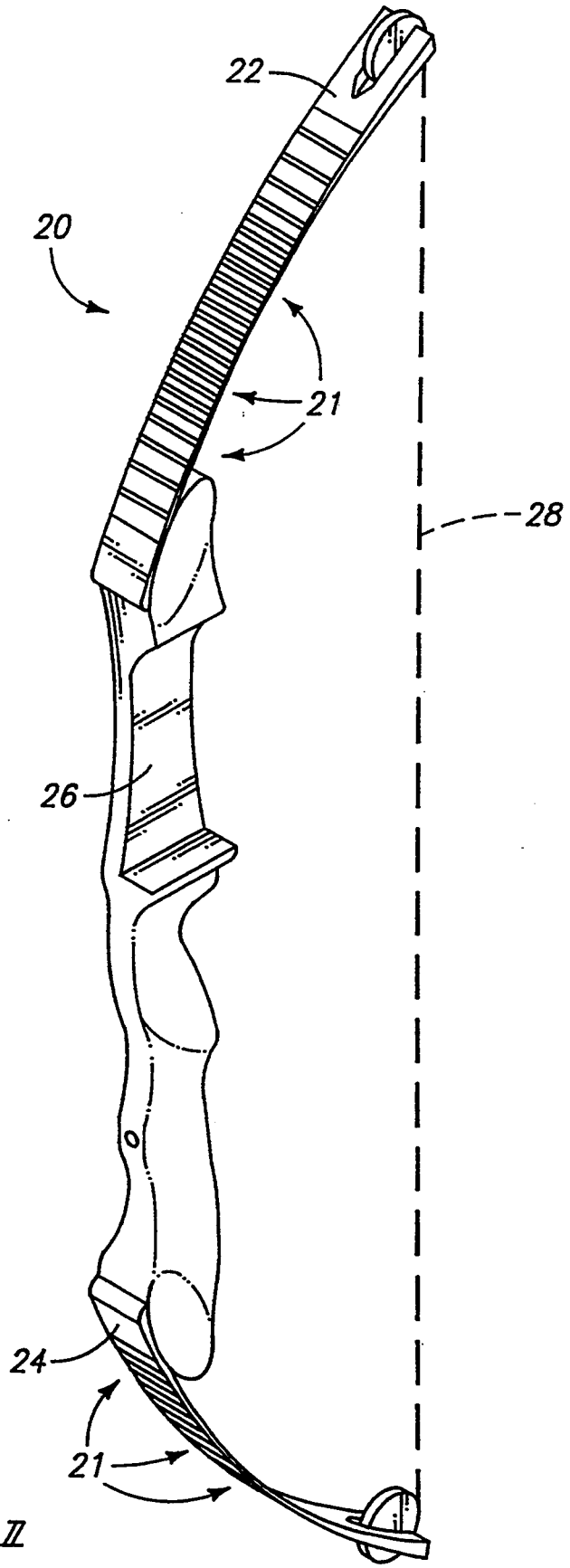
FIG. 1 is an isometric view of an archery bow including a preferred embodiment of a radiation shielding apparatus according to the present invention.

More particularly with reference to FIG. 1, an archery bow 20 includes a handle riser 26, opposing bow limbs 22, 24 (upper and lower bow limbs, respectively) coupled to the handle riser, and a bow string 28 extending between the opposing bow limbs. A radiation shielding apparatus is indicated generally with numeral 21.

Figure 7:
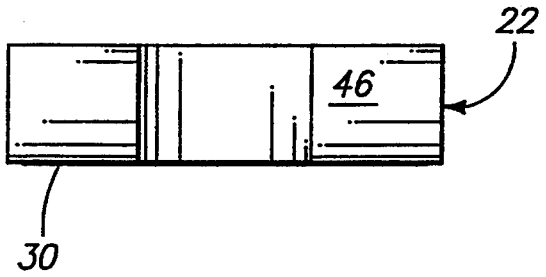
FIG. 7 is a top view of the bow limb and radiation shielding apparatus of FIG. 2.
Figure 8:
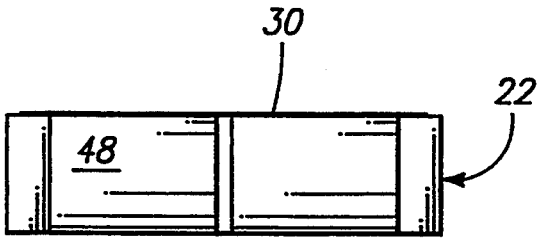
FIG. 8 is a bottom view of the bow limb and radiation shielding apparatus of FIG. 2.

Referring to FIGS. 2–5, each bow limb includes an outer face 40, an inner face 42, and side edges 23, 25 which define a series of face widths extending therebetween. As is apparent, the limb face widths vary in dimension. Each limb has a length defined by a top or distal end 46 and a bottom or proximal end 48 (FIGS. 7 and 8, respectively). The proximal end 48 is coupled to the handle riser 26 of the bow 20. A bowstring 28 (FIG. 1) is coupled to the distal end 46 of the bow limb by an eccentric wheel, cam, or other conventional manner. It is to be understood that the configuration of limbs 22, 24 is provided for illustration purposes only. Radiation shielding apparatus in accordance with the invention may used with virtually any size or type of bow limb.

Figure 6:
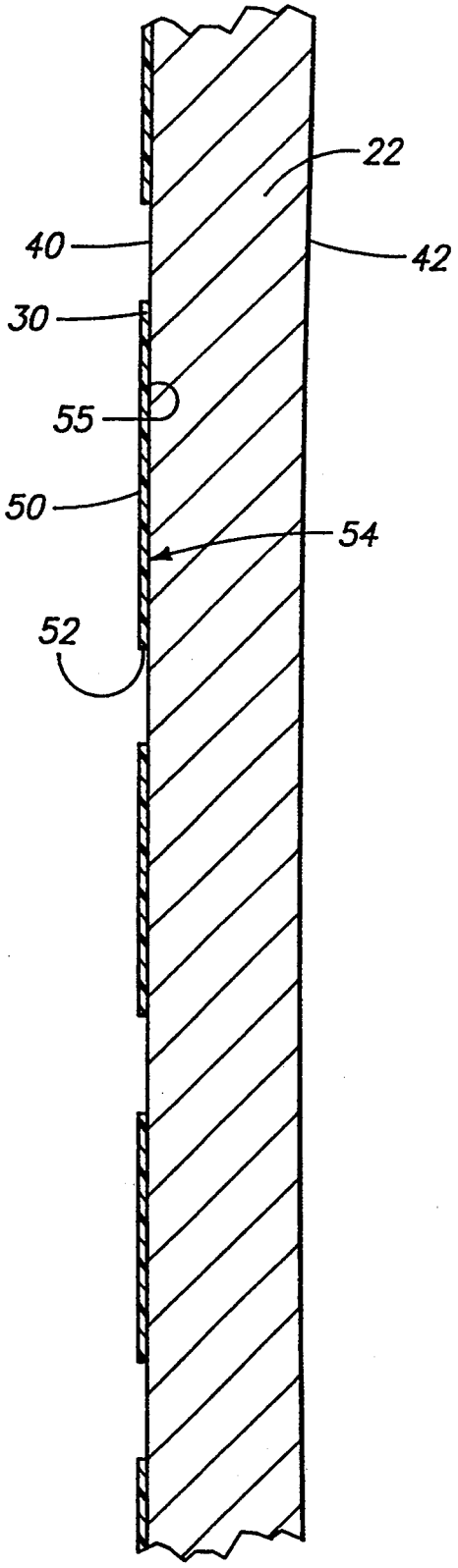
FIG. 6 is an enlarged, partial sectional side elevational view of the bow limb and radiation shielding apparatus of FIG. 2.

The radiation shielding apparatus 21 comprises a plurality of thin sheets of material 30 for adherence to a given bow limb. As shown in FIG. 6, each sheet 30 has an outer surface 50 (described in greater detail below)

and an inner surface 55. Inner surface 55 is flat or otherwise adapted or configured for adherence to one of bow limb faces 40, 42. In a preferred embodiment, an adhesive 54 is applied to the inner surface 55 so that the sheet 30 can be easily and removably adhered to a bow limb face. Each sheet further includes peripheral edges 52 determined by the thickness of the sheet 30.

Figure 2:
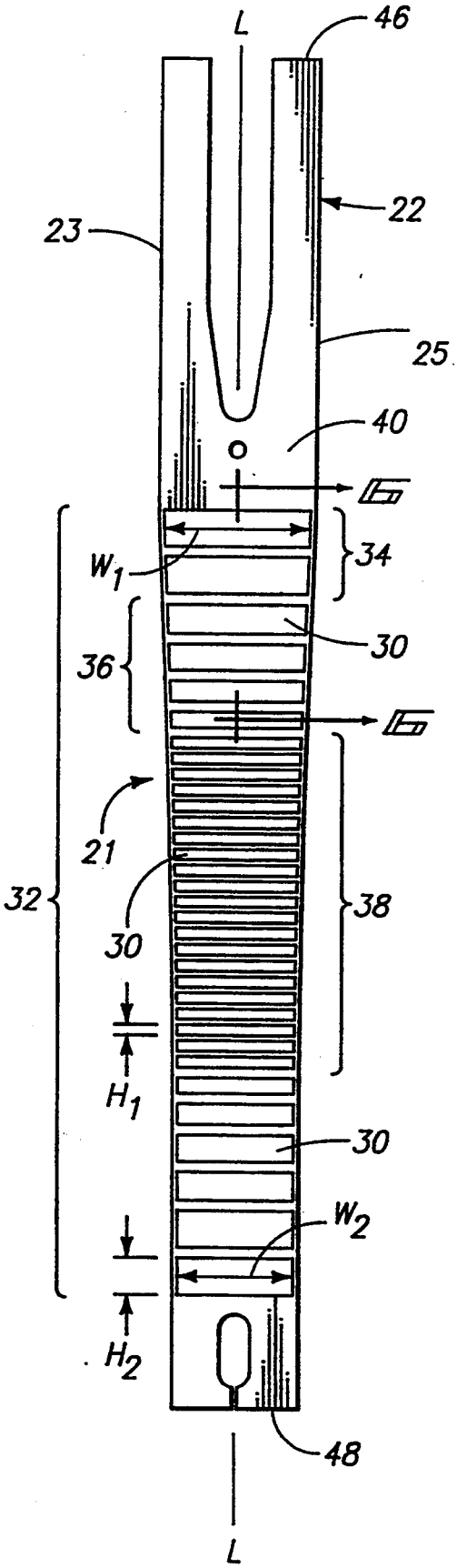
FIG. 2 is a front elevational view of a bow limb including a preferred embodiment of the radiation shielding apparatus.
Figure 3:
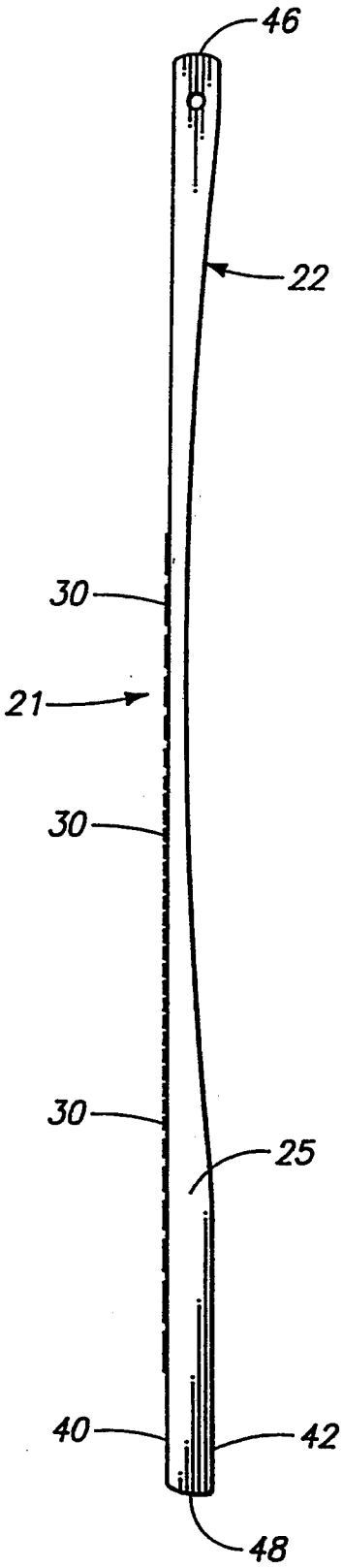
FIG. 3 is a right side elevational view of the bow limb and radiation shielding apparatus of FIG. 2.
Figure 4:
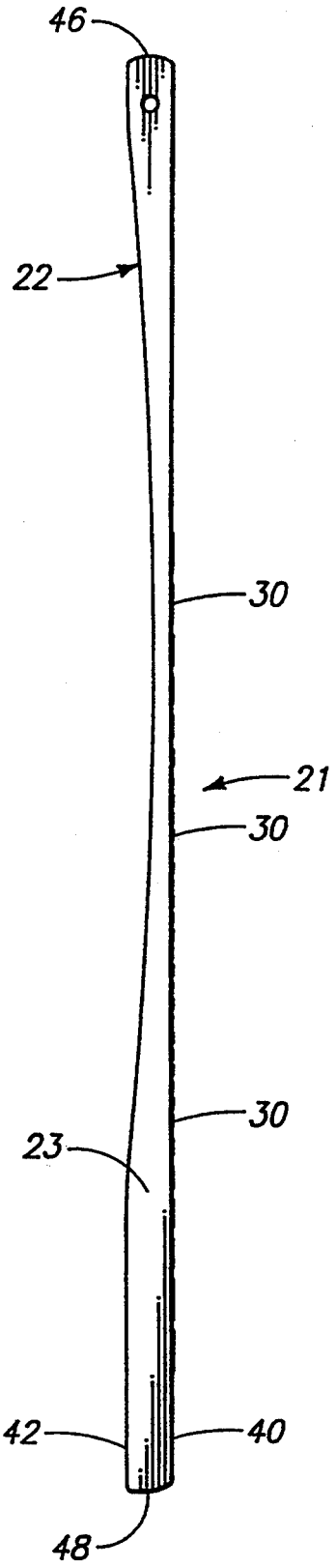
FIG. 4 is a left side elevational view of the bow limb and radiation shielding apparatus of FIG. 2.

Referring back to FIG. 2, the sheets of material 30 are comprised of different sizes. The sheets are preferably comprised of multiple height dimensions, including at least short sheets of a first height $H_1$ and tall sheets of a second height $H_2$. A variety of sheet heights may be used between the short and tall sheets, as shown in FIG. 2, to form a spectrum of sheet heights. The tall sheets are intended to be positioned toward opposite ends of a bow limb face 40, with the short sheets being positioned between the tall sheets. The sheets are generally spaced from one another along a longitudinal axis L of the bow limb.

Referring still to FIG. 2, the sheets of material 30 are positioned on a bow limb 22 along a working length 32 of the bow limb. The working length 32 is the area of maximum limb flexion when the bow is drawn. Tall sheets ($H_2$) are positioned at extreme edge sections 34 (only one labeled) of the working length 32. Thin sheets ($H_1$) are positioned in a middle section 38, with sheets of intermediate heights being positioned in intermediate sections 36 (only one labeled).

Multiple sheets and sheets of varying heights stems are used to compensate for the flexion of the bow limb. A continuous sheet of material would not be preferred because it would tend to pucker and bubble when the working length 32 flexes. Smaller heights ($H_1$) are utilized in areas where the greatest amount of limb flexion occurs.

The sheets of material 30 are generally rectangular and are comprised of multiple width dimensions ($W_1$–$W_2$). The width dimensions of the sheets are complimentary in size to the corresponding width dimensions of the bow limb face 40 such that the sheets substantially span the respective bow limb face widths. Sheets vary starting from a wide sheet $W_1$ positioned toward the top of the limb and narrowing progressively to a narrow sheet $W_2$ positioned toward the bottom of the limb, corresponding to the particular respective limb width. At least some of the tall sheets $H_2$ (located in upper section 34) have a larger width dimension than the first height sheets $H_1$ (located in section 38) to substantially span larger width regions of the bow limb than the first height sheets.

Referring to FIGS. 2 and 6, the outer surface 50 of each sheet 30 is glossy and reflective of light radiation to deflect light away from the bow limb 22 when inner surface 55 is adhered to bow limb 22 to minimize heating of bow limb 22. The reflective surface may be a metallic color, such as gold, silver, bronze, or any other color that will reflect the maximum light possible away from the bow limb. The reflection of light away from the limb serves to minimize heating of the limb and thereby enhance the performance and consistency of the bow, especially when outdoors in sunlight.

Each sheet 30 is preferably adapted to be removably adhered to a bow limb face 40. An adhesive 54 is applied to the inner surface 55 of the sheet 30. The adhesive is preferably of a type that allows the material to be adhered to the bow limb face 40 and subsequently removed by peeling the sheet from the bow limb face. Hence, the removable sheets 30 can be adhered, for example, to a camouflaged bow limb for target archery and later removed to reveal the camouflaged bow limb for hunting purposes.

In the embodiment shown in FIGS. 2–4, and 6–8, a radiation shielding apparatus 21 is adhered only to the outer surface 40 of the bow limb 22. There is no shielding apparatus coupled to the inner surface in this first embodiment.

Figure 5:
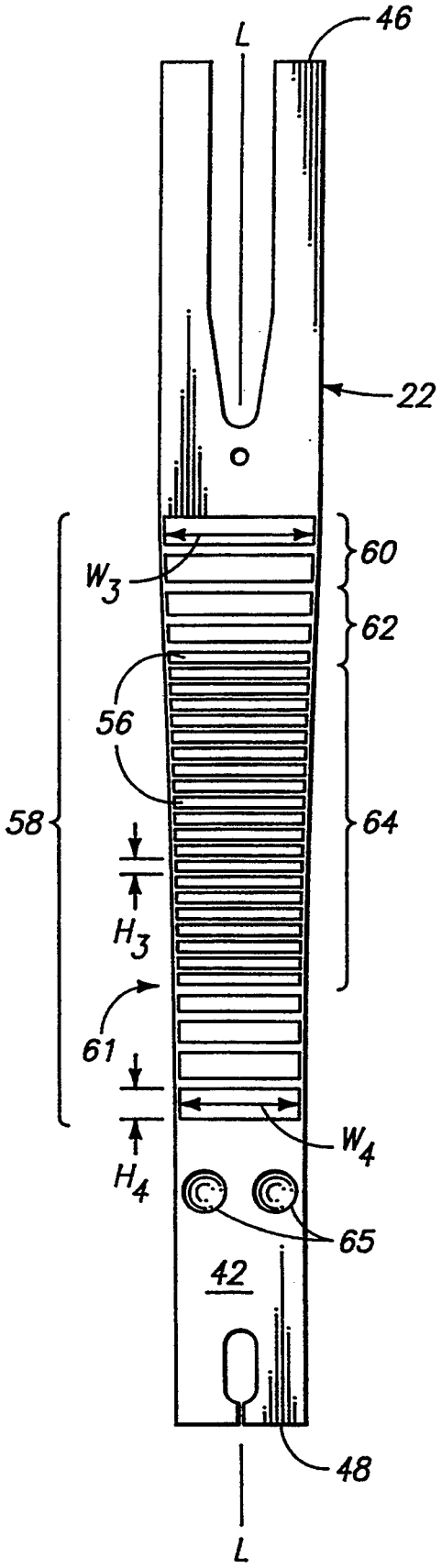
FIG. 5 is a rear elevational view of an alternative embodiment of the radiation shielding apparatus according to the present invention.
Figure 9:
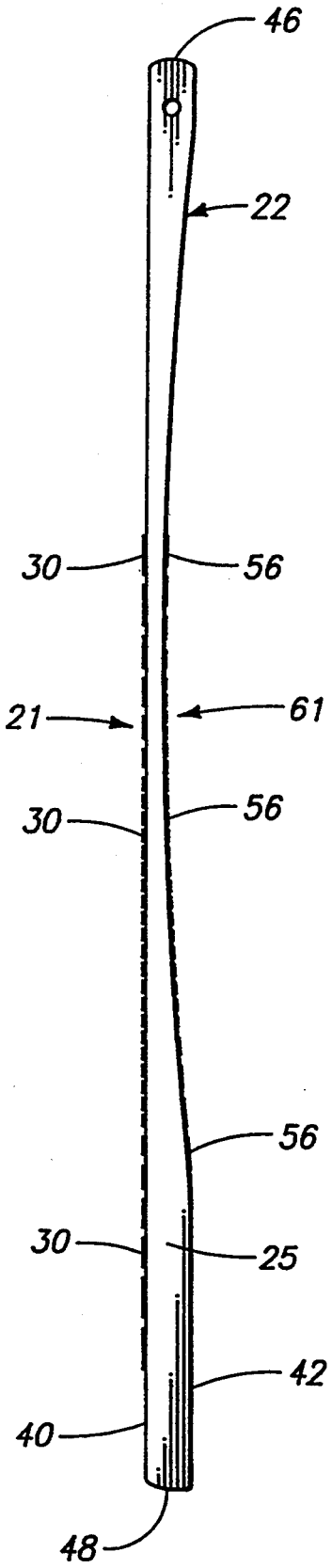
FIG. 9 is a right side elevational view of the bow limb and radiation shielding apparatus of FIG. 5.
Figure 10:
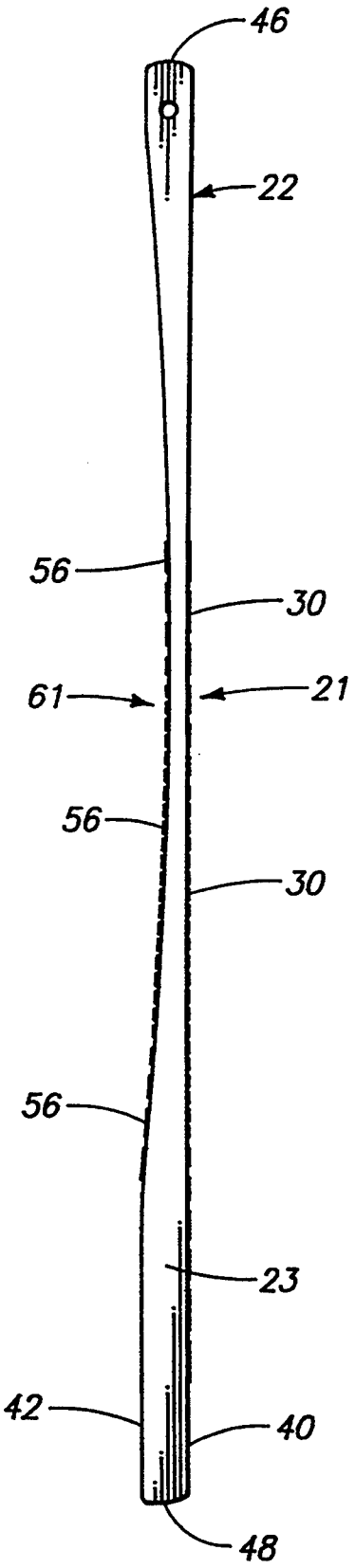
FIG. 10 is a left side elevational view of the bow limb and radiation shielding apparatus of FIG. 5.

FIGS. 5, 9, and 10 show an alternative embodiment of a radiation shielding apparatus 61. A second radiation shielding apparatus 61 (in addition to radiation shielding apparatus 21 shown in FIGS. 2–4) is adhered to the inner face 42 of the bow limb 22 for improved reflection of light radiation away from the bow limb. The construction, application, and purpose of the second embodiment of the shielding apparatus 61 is substantially the same as the radiation shielding apparatus 21 described above.

The shielding apparatus 61 includes a plurality of thin sheets of material 56 for adherence to a given bow limb. The characteristics of the sheets 56 are the same as those described in connection with the sheets 30 of FIG. 6.

As shown in FIG. 5, the sheets of material 56 are positioned on the inner face 42 of a bow limb 22 in a spectrum of different heights ($H_3$–$H_4$) along a working length 58 of the bow limb. The working length 58 is the area of maximum limb flexion when the bow is drawn. Tall sheets ($H_4$) are positioned at extreme edge sections 60 (only one labeled) of the working length 58. Short sheets ($H_3$) are positioned in a middle section 64, with sheets of intermediate heights being positioned in intermediate sections 62 (only one labeled).

As described above, multiple sheets and sheets of varying heights stems are used to compensate for the flexibility of the bow limb. Smaller heights ($H_3$) are used for areas of maximum limb flexion. The shielding apparatus 61 is relatively shorter than radiation shielding apparatus 21 because a portion of the handle riser 26 covers the lower area of the limb 22 (FIG. 5) shown without sheets 56. The two cavities 65 provide bearing surfaces for a conventional limb adjustment means used in connection with the handle riser 26.

The sheets of material 56 are generally rectangular and are comprised of multiple width dimensions ($W_3$–$W_4$). The width dimensions of the sheets are complimentary in size to the corresponding width dimensions of the bow limb face 42 such that the sheets substantially span the respective bow limb face widths. As shown in FIG. 5, the sheets vary starting from a wide sheet $W_3$ positioned toward the top of the limb and narrowing progressively to a narrow sheet $W_4$ positioned toward the bottom of the limb.

Figure 11:
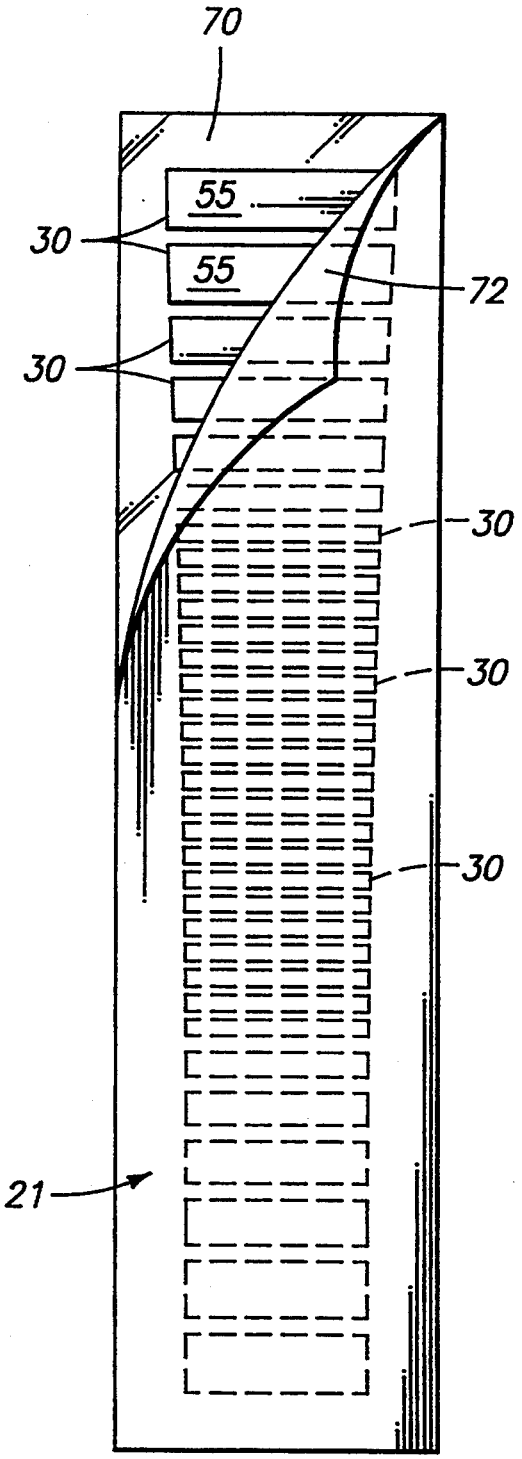
FIG. 11 is a front elevational view of another alternative embodiment of the radiation shielding apparatus according to the present invention.

With reference to FIG. 11, an alternative embodiment of the sheets of material 30 is shown. The sheets 30 are removably disposed between a first backing panel 72 and a second backing panel 70. In FIG. 11, the first backing panel 72 is shown partially peeled away from the sheets 30 to expose the inner surfaces 55, which are coated with adhesive. The glossy reflective surfaces (not shown in FIG. 11) of the material sheets 30 are secured against second backing panel 70.

When the sheets 30 are to be installed on a bow limb face, the first backing panel 72 is removed to expose the adhesive on the inner surfaces of the sheets 30. The sheets, along with the second backing panel 70, are then positioned at a proper location on a bow limb face. The a second backing panel 70 is then removed, leaving the sheets 30 on the bow limb face with the glossy reflective surface exposed. The sheets can later be readily removed from the bow limb face, if desired. While installed on the bow limb face, the sheets serve to deflect light radiation away from bow limb to minimize heating of bow limb.

In compliance with the statute, the invention has been described in language necessarily limited in its ability to properly convey the conceptual nature of the invention. Because of this inherent limitation of language, it must be understood that the invention is not necessarily limited to the specific features described, since the means herein disclosed comprise merely preferred forms of putting the invention into effect. The invention is, therefore, claimed in any of its forms or modifications within the proper scope of the appended claims appropriately interpreted in accordance with the doctrine of equivalents.

I claim:

1. For an archery bow having a handle portion, opposing bow limbs coupled thereto, and a bow string extending between the opposing bow limbs, the limbs each having opposing outer and inner faces and having side edges which define a series of face widths therebetween, each outer limb face having a length; a radiation shielding apparatus comprising:

a thin sheet of material, the sheet having an outer surface and an inner surface, the inner surface being adapted for adherence to a bow limb face, the outer surface being glossy and reflective of light radiation to deflect light away from a bow limb when the inner surface is adhered to a bow limb to minimize heating of a bow limb.

2. The radiation shielding apparatus of claim 1, further comprising a plurality of sheets of material for adherence to a given bow limb, the sheets being comprised of different sizes.

3. The radiation shielding apparatus of claim 1, further comprising a plurality of sheets of material for adherence to a given bow limb, each sheet having a height dimension, the sheets being comprised of multiple height dimensions.

4. The radiation shielding apparatus of claim 1 wherein the sheet of material includes a width dimension to substantially span a respective bow limb face width.

5. The radiation shielding apparatus of claim 4 wherein the series of face widths includes different face widths, the sheets being comprised of multiple height dimensions comprising at least sheets of a first height and sheets of a second height, the second height being greater than the first height;

wherein at least some of the second height sheets have a larger width dimension than the first height sheets to substantially span larger width regions on the bow limb than the first height sheets.

6. The radiation shielding apparatus of claim 5 wherein the sheets are rectangular.

7. The radiation shielding apparatus of claim 4, further comprising a plurality of sheets of material for adherence to a given bow limb, each sheet having a height dimension, the sheets being comprised of multiple height dimensions including tall sheets and short sheets, the sheets being adhereable on a bow limb face with the tall sheets being positionable toward opposite ends of a bow limb face and the short sheets being positionable between the tall sheets.

8. The radiation shielding apparatus of claim 4, further comprising a plurality of sheets of material, each sheet being generally rectangular and having a height dimension, the sheets being comprised of multiple height dimensions including tall sheets and short sheets, the sheets being adhereable on a bow limb face with the height dimensions aligned along a longitudinal axis of the bow limb, the tall sheets being positionable toward opposite ends of the bow limb face and the short sheets being positionable between the tall sheets, and the sheets being spaceable from one another along a longitudinal axis.

9. The radiation shielding apparatus of claim 1 wherein the sheet of material is adapted to be removably adhered to a bow limb face.

10. The radiation shielding apparatus of claim 1 wherein the sheet of material includes an adhesive on the inner surface which allows the sheet to be removably adhered to a bow limb face.

11. The radiation shielding apparatus of claim 1 wherein the outer surface of the sheet is a metallically glossy reflective surface.

12. An archery bow comprising:

a handle portion having opposing ends;

opposing bow limbs coupled to the opposing ends of the handle portion, the limbs each having opposing outer and inner faces and having side edges which define a series of face widths therebetween, each outer limb face having a length;

a bow string extending between the opposing bow limbs; and a thin sheet of material, the sheet having an outer surface and an inner surface, the inner surface adhered to the outer face of one limb, the sheet of material having a width dimension sufficient to substantially span a respective outer bow limb face width, the outer surface being glossy and reflective of light radiation to deflect light away from the one bow limb to minimize heating of the one bow limb.

13. The archery bow of claim 12, further comprising a plurality of sheets of material, the sheets being of different sizes.

14. The archery bow of claim 12, further comprising a plurality of sheets of material, each sheet having a height dimension, the sheets being comprised of multiple height dimensions.

15. The archery bow of claim 12, further comprising a plurality of sheets of material, each sheet having a height dimension, the sheets being comprised of multiple height dimensions including tall sheets and short sheets, the sheets being adhered to the bow limb face with the tall sheets being positioned toward opposite ends of the bow limb face and the short sheets being positioned between the tall sheets.

16. The archery bow of claim 12, further comprising a plurality of sheets of material, each sheet being generally rectangular and having a height dimension, the sheets being comprised of multiple height dimensions including tall sheets and short sheets, the sheets being adhered to the bow limb face with the height dimensions aligned along a longitudinal axis of the bow limb, the tall sheets being positioned toward opposite ends of the bow limb face and the short sheets being positioned between the tall sheets, the sheets being spaced from one another.

17. The archery bow of claim 12 wherein the sheet of material is removably adhered to the bow limb face.

18. The archery bow of claim 12 wherein the sheet of material includes an adhesive on the inner surface for allowing the sheet to be removably adhered to the bow limb face.

19. The archery bow of claim 12 wherein the outer surface of the sheet is a metallically glossy reflective surface.

20. An archery bow comprising:

a handle portion having opposing ends;

opposing bow limbs coupled to the opposing ends of the handle portion, the limbs each having opposing outer and inner faces and having side edges which define a series of face widths therebetween, each outer limb face having a length;

a bow string extending between the opposing bow limbs; and sheet means removably adhered to the outer face of one of said bow limbs, said sheet means having an outer surface and an inner surface, the sheet means outer surface being glossy and reflective of light radiation to deflect light away from said bow limb to minimize heating thereof.

21. For an archery bow having a handle portion, opposing bow limbs coupled thereto, and a bow string extending between the opposing bow limbs, the limbs each having opposing outer and inner faces and having side edges which define a series of face widths therebetween, each outer limb face having a length; a radiation shielding apparatus comprising:

a first backing panel;

a thin sheet of material removably disposed on said first backing panel, the sheet having an outer surface and an inner surface, the inner surface being adapted for adherence to an outer face of a bow limb, the outer surface being reflective of light radiation to deflect light away from a bow limb to minimize heating of a bow limb.

22. The radiation shield apparatus according to claim 21, further comprising multiple sheets of material, each sheet of material having a height dimension, the multiple sheets being comprised of different heights including tall sheets and short sheets, the sheets being arranged on the first backing panel for adherence on a bow limb face having the height dimensions aligned with a longitudinal axis of a bow limb with the short sheets being arranged between the tall sheets.

23. The radiation shield apparatus according to claim 21, further comprising a second backing panel, the inner surface of the sheet of material being removably adhered to the first backing panel, and the outer surface of the sheet being removably adhered to the second backing panel.

24. The radiation shield apparatus according to claim 22, further comprising a second backing panel, the inner surface of the sheet of material being removably adhered to the first backing panel, and the outer surface of the sheet being removably adhered to the second backing panel.

* * * * *